US007422161B2

(12) United States Patent
Hou et al.

(10) Patent No.: US 7,422,161 B2
(45) Date of Patent: Sep. 9, 2008

(54) TREATED PORT FUEL INJECTORS

(75) Inventors: Peter W. Hou, Chesterfield, VA (US); Dennis J. Malfer, Glen Allen, VA (US); Thomas William Nichols, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 425 days.

(21) Appl. No.: 11/393,271

(22) Filed: Mar. 30, 2006

(65) Prior Publication Data

US 2007/0235566 A1 Oct. 11, 2007

(51) Int. Cl.
*B05B 1/28* (2006.01)
*C10L 1/22* (2006.01)

(52) U.S. Cl. ..... 239/104; 44/415

(58) Field of Classification Search ..... 239/104, 239/533.2, 585.1, 585.4, 585.5
See application file for complete search history.

(56) References Cited

U.S. PATENT DOCUMENTS

| | | | | |
|---|---|---|---|---|
| 3,361,673 | A | 1/1968 | Stuart et al. | |
| 3,676,089 | A | 7/1972 | Morris et al. | |
| 4,231,759 | A | 11/1980 | Udelhofen et al. | |
| 4,234,435 | A | 11/1980 | Meinhardt et al. | |
| 4,238,628 | A | 12/1980 | Cahill et al. | |
| 5,300,701 | A | 4/1994 | Cherpeck | |
| 5,393,309 | A | 2/1995 | Cherpeck | |
| 5,514,190 | A | 5/1996 | Cunningham et al. | |
| 5,620,486 | A | 4/1997 | Cherpeck | |
| 5,634,951 | A | 6/1997 | Colucci et al. | |
| 5,697,988 | A | 12/1997 | Malfer et al. | |
| 5,725,612 | A | 3/1998 | Malfer et al. | |
| 5,771,873 | A * | 6/1998 | Potter et al. | 123/668 |
| 5,783,261 | A * | 7/1998 | Potter et al. | 427/526 |
| 5,876,468 | A | 3/1999 | Moreton | |
| 6,145,763 | A * | 11/2000 | Fleming et al. | 239/585.1 |
| 6,267,307 | B1 * | 7/2001 | Pontoppidan | 239/585.4 |
| 6,548,458 | B2 | 4/2003 | Loper | |
| 6,679,231 | B2 * | 1/2004 | Kabat et al. | 123/527 |
| 6,715,693 | B1 * | 4/2004 | Dam et al. | 239/88 |
| 6,800,103 | B2 | 10/2004 | Malfer et al. | |
| 2004/0129313 | A1 * | 7/2004 | Aharonov et al. | 137/375 |
| 2004/0176502 | A1 | 9/2004 | Raymond et al. | |
| 2005/0066572 | A1 | 3/2005 | Colucci et al. | |

FOREIGN PATENT DOCUMENTS

| | | |
|---|---|---|
| EP | 0 623 631 B1 | 2/1998 |
| EP | 1 411 105 A2 | 4/2001 |

OTHER PUBLICATIONS

U.S. Appl. No. 11/336,037, filed Jan. 20, 2006, Hou et al.

* cited by examiner

*Primary Examiner*—Thomas N Moulis
(74) *Attorney, Agent, or Firm*—Dennis H. Rainear; Paige J. Thomson; J. Clay Matthews

(57) ABSTRACT

Treated port fuel injectors are disclosed. The treated port fuel injectors have a surface coated with a film which resists or limits deposit formation on the injector surface. The film may be formed by contacting the port fuel injector with: (i) a succinimide compound comprising the reaction product of polyisobutylene-substituted succinic anhydride and a polyamine; (ii) a Mannich base detergent; and (iii) a spark ignition fuel. The treated port fuel injectors may also include a film formed by contacting the port fuel injector with: (i) a Mannich condensation reaction product of a polyamine having a sterically-hindered primary amino group, a hydrocarbyl-substituted hydroxyaromatic compound, and an aldehyde; and (ii) a spark ignition fuel. Methods of forming films on port fuel injector surfaces are also disclosed.

32 Claims, No Drawings

TREATED PORT FUEL INJECTORS

FIELD OF THE INVENTION

Treated port fuel injectors, having a film formed on a surface to reduce or prevent the formation of deposits, are disclosed. Methods of forming films on port fuel injectors are also disclosed.

BACKGROUND OF THE INVENTION

As is well known, port fuel injectors in internal combustion engines can become fouled due to the formation of deposits. Such fouling can adversely affect engine performance. For example, deposits on port fuel injectors can restrict fuel flow and disrupt spray patterns by partially obstructing or plugging up metering holes of the injector tip. There has been considerable work devoted to additives for effectively controlling engine deposits. However, this work has tended to focus primarily on intake valve deposits and, to some extent, on combustion chamber deposits. Many additives, which may be effective in reducing intake valve deposits and combustion chamber deposits, are not effective at preventing port fuel injector fouling. This is believed to be due to, for example, the differences in the temperatures of the different engine regions; the port fuel injectors being considered a so-called "cooler" engine region than the intake valves and combustion chamber. Additionally, many deposit control additives perform only as long as the additive is being used, i.e., is passing through the injector. Thus, the port fuel injectors become quickly fouled once a fuel which does not contain deposit control additives or effective deposit control additives is passed through the port fuel injectors.

SUMMARY OF THE INVENTION

In accordance with one embodiment, a treated port fuel injector comprises a port fuel injector having a surface coated by a film, wherein the film is formed by contacting the port fuel injector with: (i) a succinimide compound comprising the reaction product of polyisobutylene-substituted succinic anhydride and a polyamine; (ii) a Mannich base detergent; and (iii) a spark ignition fuel, wherein the film resists deposit formation and remains on the port fuel injector surface after the contacting ceases.

In accordance with another embodiment, a method for forming a film on a port fuel injector surface for resisting deposit formation comprises introducing into the port fuel injector: (i) a succinimide compound comprising the reaction product of polyisobutylene-substituted succinic anhydride and a polyamine; (ii) a Mannich base detergent; and (iii) a spark ignition fuel. The method further comprises contacting the surface of the port fuel injector with the succinimide compound, the Mannich base detergent, and the spark ignition fuel, and depositing a film on the surface, wherein the film resists deposit formation and remains on the port fuel injector surface after the contacting ceases.

In accordance with yet another embodiment, a treated port fuel injector comprises a port fuel injector having a surface coated by a film, wherein the film is formed by contacting the port fuel injector with: (i) a Mannich condensation reaction product of a polyamine having a sterically-hindered primary amino group, a hydrocarbyl-substituted hydroxyaromatic compound, and an aldehyde; and (ii) a spark ignition fuel, wherein the film resists deposit formation and remains on the port fuel injector surface after the contacting ceases.

In accordance with a further embodiment, a method for forming a film on a port fuel injector surface for resisting deposit formation comprises introducing into the port fuel injector: (i) a Mannich condensation reaction product of a polyamine preferably having-a sterically-hindered primary amino group or at the very least having one amine that does not react as rapidly as the first primary amine, a hydrocarbyl-substituted hydroxyaromatic compound, and an aldehyde; and (ii) a spark ignition fuel. The Mannich product in one embodiment will contain an amount of primary amine sufficient to form the film on the port injector. The method further comprises contacting the surface of the port fuel injector with the Mannich reaction product and the spark ignition fuel and depositing a film on the surface, wherein the film resists deposit formation and remains on the port fuel injector surface after the contacting ceases.

Treated port fuel injectors and methods of forming films on port fuel injector surfaces provide numerous advantages in the art. For example, the treated port fuel injectors provide improved engine performance by preventing or reducing disruptions of the fuel flow. Significantly, the treated port fuel injectors resist or limit deposit formation on injector surfaces, even when fuels containing no deposit control additive or deposit control additives of limited effectiveness are utilized in the engine. Treated port fuel injectors and films which resist or limit deposit formation can be formed by simple, yet effective methods. Additionally, conventional port fuel injectors can be easily and effectively rendered resistant to deposit formation.

Other embodiments and features will become still further apparent from the ensuing description and appended claims.

DETAILED DESCRIPTION OF THE PREFERRED EMBODIMENTS

Treated port fuel injectors, according to an embodiment, may comprise a port fuel injector having a surface coated by a film for resisting deposit formation. The port fuel injector may include any port fuel injector suitable for use in spark ignition internal combustion engines and a multitude of port fuel injectors are commercially available. Selecting a suitable port fuel injector for a particular engine and application is well within the ordinary skill of those in the art.

A film coated on a port fuel injector surface may comprise a variety of structures. The film may comprise a monolayer or multi-layer molecular structure and may be chemically or physically bonded to the port fuel injector surface. Advantageously, the film may be sustainable, i.e., may remain on the surface of the port fuel injector after being formed and during subsequent operation of the port fuel injector. For example, the film may be formed by contacting the port fuel injector surface with one or more components in accordance with the disclosure, and may remain on the port fuel injector surface after the contacting ceases. The film may also remain on the surface and provide deposit control during subsequent operation of the port fuel injector, i.e., when a fuel is flowing through the injector, even when the fuel does not contain a deposit control additive.

In one embodiment, the film for resisting deposit formation may be formed on the port fuel injector surface by contacting the surface of the port fuel injector with: (i) a succinimide compound comprising the reaction product of polyisobutylene-substituted succinic anhydride and a polyamine; (ii) a Mannich base detergent; and (iii) a spark-ignition fuel. For example, the succinimide compound and the Mannich base detergent may be blended, e.g., individually or concurrently, with the spark ignition fuel and then provided to the engine to be used as the fuel composition. The blended components, once provided to the engine, may be introduced into the port fuel injector(s), upon operation of the engine. The blended components then may flow along and contact the surface(s) of the port fuel injector(s). As the blended components contact the surface, the film may be deposited and left behind on the injector surface. Advantageously, since the film is left behind on the surface, it continues to provide deposit control for the injector, even after the blended components stop contacting the injector surface. For example, if a fuel which does not contain the blended components is subsequently provided to the engine, e.g., a base fuel is provided after the blended components have been provided, the film continues to resist deposit formation.

The blended components used to form the film may be present in a variety of relative amounts. In some embodiments, the succinimide compound may be present in an amount of from about 0.1 to about 15 ptb (pounds by weight of additive per thousand barrels by volume of fuel), for example, from about 1 to about 5 ptb. The Mannich base detergent may, in some embodiments, be present in an amount of from about 5 to about 100 ptb, for example, from about 40 to about 80 ptb.

The succinimide compound, utilized in forming the film for resisting deposit formation, comprises the reaction product of a polyisobutylene-substituted succinic anhydride and a polyamine. Polyisobutylene-substituted succinic anhydrides may be prepared, for example, by the reaction of maleic anhydride with polyisobutylene. The maleic anhydride and polyisobutylene can be combined in various relative amounts. In many examples, the maleic anhydride is used in stoichiometric excess, e.g., 1.1-5 moles maleic anhydride per mole of polyisobutylene. Reaction conditions for producing hydrocarbyl-substituted succinic anhydrides are well known in the art. For example, U.S. Pat. Nos. 3,361,673 and 3,676,089, and European Patent 0 623 631 B 1 describe preparing hydrocarbyl-substituted succinic anhydrides by the thermal reaction of a polyolefin and maleic anhydride. A further discussion of hydrocarbyl-substituted anhydrides can be found, for example, in U.S. Pat. Nos. 4,234,435, 5,620,486, and 5,393,309.

Any of numerous polyamines may be utilized in preparing the succinimide compounds. Exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines comprising small amounts of lower polyamine oligomers such as TEPA and PEHA, but primarily oligomers with 7 or more nitrogens, 2 or more primary amines per molecule, and more extensive branching than conventional polyamine mixtures. Additional polyamines which may be utilized in preparing succinimide compounds are disclosed in U.S. Pat. No. 6,548,458. In many embodiments, the polyamine may comprise tetraethylene pentamine (TEPA).

The conditions for reacting the polyisobutylene-substituted succinic anhydride and the polyamine are well known in the art. The reaction is typically performed at an elevated temperature, for example, from about 80 to about 200° C., e.g., about 150 to about 175° C., and the generated water is removed. The polyisobutylene-substituted succinic anhydride (PIBSA) and polyamine may be present in various amounts. The PIBSA and polyamine may be present in a ratio of from about 2:1 to about 1:1, for example, about 1.6:1. In some embodiments, the ratio of PIBSA to polyamine may be about 1:1.

Any of a multitude of Mannich base detergents may be utilized in embodiments, and a variety of Mannich base detergents are described in the literature and are commercially available. For example, exemplary Mannich base detergents are described in U.S. Pat. Nos. 4,231,759, 5,514,190, 5,634,951, 5,697,988, 5,725,612, 5,876,468, and 6,800,103 the disclosures of which are incorporated herein by reference.

Mannich base detergents include the reaction product of a hydroxyaromatic compound, an amine, and an aldehyde. Hydroxyaromatic compounds may be unsubstituted or substituted, e.g., mono- or di-substituted. Substituted hydroxyaromatic compounds may include phenols or cresols including one or more of a variety of substituents. Exemplary substituents may include aliphatic hydrocarbyl substituents such as polypropylene, polybutene, polybutylene, polyisobutylene or an ethylene alpha-olefin copolymer having a number average molecular weight in the range of from about 500 to about 3000.

The alkylation of the hydroxyaromatic compound is typically performed in the presence of an alkylating catalyst at a temperature in the range of from about 30 to about 200° C. Exemplary alkylating catalysts may include sulphuric acid, $BF_3$, aluminum phenoxide, methanesulphonic acid, cationic exchange resin, acidic clays, and modified zeolites. Methods of alkylating hydroxyaromatic compounds are well known in the art, for example, as taught in GB 1,159,368 and U.S. Pat. Nos. 4,238,628, 5,300,701, and 5,876,468.

A variety of amines may be utilized in forming Mannich base detergents. The amines may be linear, branched or cyclic alkylene monoamines or polyamines having at least one suitably reactive primary or secondary amine group in the molecule. Exemplary amines may include ethylenediamine, diethylenetriamine, triethylenetriamine, tetraethylenepentamine, pentaethylenehexamine, hexaethyleneheptamine, heptaethyleneoctamine, octaethyleneonamine, nonaethylenedecamine, decaethyleneundecamine, dimethylamine, diethylamine, dipropylamine, dibutylamine, dipentylamine, and dicyclohexylamine.

Representative aldehydes for use in the preparation of the Mannich base detergent may include the aliphatic aldehydes, such as formaldehyde, acetaldehyde, propionaldehyde, butyraldehyde, valeraldehyde, caproaldehyde, heptaldehyde, and stearaldehyde. Aromatic aldehydes which may be used include benzaldehyde and salicyclaldehyde. Heterocyclic aldehydes such as furfural and thiophene aldehyde may also be used. Also useful are formaldehyde-producing reagents such as paraformaldehyde or aqueous formaldehyde solutions such as formalin.

Mannich base detergents may, in some embodiments, be utilized with a liquid carrier, induction aid or fluidizer. Such carriers can be of various types, such as for example liquid poly-α-olefin oligomers, liquid polyalkene hydrocarbons (e.g., polypropene, polybutene, polyisobutene, or the like), liquid hydrotreated polyalkene hydrocarbons (e.g., hydrotreated polypropene, hydrotreated polybutene, hydrotreated polyisobutene, or the like), mineral oils, liquid poly (oxyalkylene) compounds, liquid alcohols or polyols, liquid esters, and similar liquid carriers or solvents. Mixtures of two or more such carriers or solvents can be employed.

The proportion of the liquid carrier used relative to the Mannich base can vary. In some embodiments, the weight ratio of carrier fluid to Mannich base on an active ingredient basis, i.e., excluding solvent(s), if any, used in the manufacture of the Mannich base, either during or after its formation but before addition of the carrier fluid, may be from about 0.3:1 to about 2.0:1. In some embodiments, the weight ratio of liquid carrier to Mannich base may be from about 0.5:1 to about 1.5:1.

The Mannich base detergents may be produced by reacting the hydroxyaromatic compound, amine(s), and aldehyde in accordance with reaction conditions known in the art. The condensation reaction may be conducted at a temperature in the range of from about 40 to about 200° C. Typically, the reactants are present in a molar ratio of hydroxyaromatic compound to amine to aldehyde of 1.0:0.5-2.0:1.0-3.0, respectively. The reaction can be conducted in bulk (no diluent or solvent) or in a solvent or diluent. Water is evolved and can be removed by azeotropic distillation during the course of the reaction. Typical reaction times range from 2 to 4 hours, although longer or shorter times can be used as necessary.

In an exemplary embodiment, the Mannich base detergent may comprise the reaction product of a di-substituted hydroxyaromatic compound, one or more secondary amine(s), and an aldehyde. For example, the hydroxyaromatic compound may comprise a hydroxyaromatic compound having both an aliphatic hydrocarbyl substituent derived from a polyolefin having a number average molecular weight in the range of from about 500 to about 3000, and a $C_{1-4}$ alkyl. The secondary amine may comprise dibutyl amine, and the aldehyde may comprise formaldehyde or formalin. An exemplary molar ratio for the hydroxyaromatic compound to secondary amine to aldehyde may be 1:0.8-1.5:0.8-1.5, respectively.

The spark ignition fuel may be any and all fuels suitable for use in the operation of spark ignition internal combustion engines, such as unleaded motor and aviation gasolines, and so-called reformulated gasolines, which typically contain both hydrocarbons of the gasoline boiling range and fuel-soluble oxygenated blending components such as alcohols, ethers, and other suitable oxygen-containing organic compounds. Preferred blending agents include fuel-soluble ethers such as methyl tertiary butyl ether, ethyl tertiary butyl ether, methyl tertiary amyl ether, and analogous compounds, and mixtures of such materials. Oxygenates, when used, may be present in the fuel in an amount below about 25% by volume, and in an amount that provides an oxygen content in the overall fuel in the range of from about 0.5 to about 5% by volume. However, in the practice of this invention, departures from these ranges or proportions are permissible whenever deemed necessary, appropriate or desirable.

In another embodiment, the film for resisting deposit formation may be formed on the port fuel injector surface by contacting the surface of the port fuel injector with: (i) a Mannich condensation reaction product of a polyamine having a sterically-hindered primary amino group, a hydrocarbyl-substituted hydroxyaromatic compound, and an aldehyde; and (ii) a spark-ignition fuel. For example, the Mannich condensation reaction product may be blended with the spark ignition fuel (hereinafter referred to as "the blended components") and may then be provided to the engine to be used as the fuel composition. Such Mannich condensation reaction products are disclosed in pending U.S. patent application Ser. No. 11/336,037, which is incorporated by reference in its entirety herein.

As described above, the blended components, once provided to the engine, may be introduced into the port fuel injector(s), upon operation of the engine. The blended components may then contact the surface(s) of the port fuel injector(s), depositing and leaving behind a film. As also described above, the film, once deposited, is sustainable and remains on the port fuel injector surface and continues to provide deposit control, e.g., continues to resist the formation of deposits, after the blended components stop passing through the injector. Additionally, the film remains on the port fuel injector surface and continues to resist the formation of deposits when a fuel, which may or may not contain deposit control additives, is subsequently passed through the injector.

The polyamine reactant having a sterically-hindered primary amino group, used in the Mannich reaction, includes both an amino group that does not participate in the Mannich condensation reaction and a separate suitably reactive amino group that does participate in the reaction. The reactive amino group may be a primary or secondary amino group in the molecule.

In some embodiments, the polyamine includes a primary amino group which is physically, sterically-protected to prevent or at least significantly hinder its ability to participate in the Mannich reaction. Polyamines having such steric hindrance provided on one primary amine group of the molecule may include aliphatic cyclic polyamines and acyclic aliphatic polyamines. Aliphatic cyclic polyamines may include polyaminocycloalkanes, such as polyaminocyclohexanes. Exemplary polyaminocyclohexanes may comprise 1,2-diaminodicyclohexanes, 1,3-diaminodicyclohexanes, and 1,4-diaminodicyclohexanes. Aliphatic acyclic polyamines may include alkylene polyamines. Generally, the sterically hindered primary amino group is attached to either a secondary or tertiary carbon atom in the polyamine compound. Acyclic aliphatic polyamines may include those having the following exemplary, non-limiting structures:

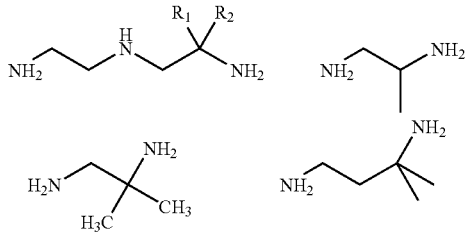

wherein $R_1$ and $R_2$ are a hydrocarbyl group or hydrogen provided that at least one thereof is a hydrocarbyl group. The hydrocarbyl group may be a $C_1$ to $C_8$ alkyl such as methyl, ethyl, propyl, isopropyl, and so forth.

The hydrocarbyl-substituted hydroxyaromatic compound used in the Mannich reaction includes at least one hydrocarbyl substituent having an average molecular weight ($M_w$) in the range of from about 300 to about 2,000, particularly about 500 to about 1,500, as determined by gel permeation chromatography (GPC). Representative hydrocarbyl substituents include those disclosed with respect to the above-described embodiment of the invention. In one embodiment, the hydroxyaromatic compound may comprise polyisobutylene-substituted cresol.

Aldehydes, useful in preparing the Mannich reaction products, include those utilized in the above-described embodiment. In some embodiments, formaldehyde or formalin may be utilized.

The Mannich reaction conditions used to prepare the Mannich products of this embodiment are in accordance with those disclosed in the above-described embodiment. For example, the reactants may be reacted at a temperature in the range of from about 40 to about 200° C., with or without diluent or solvent, and the evolved water is removed. General proportions of the Mannich reactants in this embodiment of the invention may be from 0.6 to 1.4 mole part(s) of the polyamine having the sterically-hindered primary amino group, from 0.6 to 1.4 mole part(s) of alkyl-substituted hydroxyaromatic compound, and from 0.6 to 1.4 mole part(s) of at least one aldehyde. In many embodiments, approximately equal molar proportions of the reactants are utilized.

The Mannich reaction products of this embodiment, like those used in the above-described embodiment, may be used in combination with a liquid carrier, induction aid or fluidizer. In some embodiments, the Mannich reaction products may be synthesized in the carrier fluid, or alternatively, may be combined with the carrier after reaction. Suitable carriers are disclosed above and in pending U.S. patent application Ser. No. 11/336,037.

The examples that follow are intended to further illustrate, and not limit, embodiments in accordance with the invention. All percentages, ratios, parts, and amounts used and described herein are by weight unless indicated otherwise.

EXAMPLES

Treated port fuel injectors, in accordance with embodiments of the invention, and conventional port fuel injectors (as a comparative example) were subjected to the PFI rig test, according to ASTM D-6421, to determine the ability of the injectors to resist deposit formation when challenged with fuels containing no deposit control additives.

Untreated port fuel injectors were subjected to the PFI rig test using a base fuel alone to establish a base line plugging rate for the injectors. The base fuel used was Phillip's Injector Fouling Fuel (available from Phillips Petroleum Co., Borger, Tex.). For Examples 1 and 2, a base line plugging rate of 26% was obtained. For Example 3, individual baseline plugging rates are reported with the results (identified as Test Run "0").

After establishing a baseline plugging rate, the port fuel injectors in Examples 1 and 2 were treated in accordance with embodiments of the invention and were subjected to the PFI rig test (identified as Test Run "1"). The port fuel injectors in Comparative Example 3 were subjected to the PFI rig test using conventional deposit control additives (Test Run "1"). The port fuel injectors in Examples 1-3 were then subjected a second time, and in some cases a third or even fourth time, to the PFI rig test using a base fuel alone (identified as Test Run "2", Test Run "3", etc.). Formulations, conditions, and results are provided below.

Example 1

Port Fuel Injectors Treated with the Reaction Product of PIBSA/TEPA, a Mannich Base Detergent, and a Spark Ignition Fuel A first reaction product of polyisobutylene-substituted succinic anhydride (PIBSA) and TEPA was obtained by reacting PIBSA and TEPA in a molar ratio of 1:1 at a temperature of 165-170° C. A second reaction product of PIBSA and TEPA was obtained by reacting the PIBSA and TEPA in a molar ratio of 1.6:1 at a temperature of 165-170° C. Water generated during each of the reactions was removed. For testing purposes, the reaction products were diluted by 50% with Aromatic Solvent. The first and second reaction products were separately blended with HiTEC® 6560 Detergent, a Mannich base detergent available from Afton Chemical Corporation, Richmond, Va., U.S.A., in the amounts indicated in Tables 1 and 2, and the mixtures were added to gasoline at a treat rate of 80 ptb.

Results for the PFI rig test are reported in Tables 1-2 below.

TABLE 1

| Test Run | Fuel Composition | PFI Deposits (plugging rate, %) |
|---|---|---|
| 1 | 3% PIBSA/TEPA (1:1) + HiTEC ® 6560 | 4.7 |
| 2 | Base Fuel | 3.4 |
| 3 | Base Fuel | 14.2 |

TABLE 2

| Test Run | Fuel Composition | PFI Deposits (plugging rate, %) |
|---|---|---|
| 1 | 4% PIBSA/TEPA (1.6:1) + HiTEC ® 6560 | 1.9 |
| 2 | Base Fuel | 1.8 |
| 3 | Base Fuel | 2.3 |

As can be seen in the results in Tables 1 and 2, the port fuel injectors provide excellent deposit control when the fuel composition includes (1) the reaction product of the PIBSA and the polyamine, and (2) the Mannich base detergent. Additionally, the port fuel injectors, after being treated by contact with the PIBSA and polyamine reaction product and the Mannich base detergent to form the film (in Test Run 1), provide continued, effective deposit control. Thus, after the contacting ceases, i.e., in Test Runs 2 and 3, when a fuel is subsequently passed through the injectors, the film continues to resist the formation of deposits, even when the fuel comprises a base fuel containing no deposit control additives.

Example 2

Port Fuel Injectors Treated with "DACH Mannich" and a Spark Ignition Fuel

The Mannich condensation reaction product of: a polyamine having a sterically-hindered primary amino group; a hydrocarbyl-substituted hydroxyaromatic compound; and an aldehyde ("DACH Mannich"), diluted to contain 25 wt % solvent, was added to the base fuel at a treat rate of 80 ptb. The DACH Mannich was prepared by reacting 1,2-diaminocyclohexane ("DAC") as a mixture of trans and cis isomers thereof, polyisobutylene-substituted ortho-cresol ("PIB-cresol"), and formaldehyde ("FA"). The PIB-cresol was formed by alkylating ortho-cresol with a polyisobutylene having a number average molecular weight of approximately 900. The DAC, PIB-cresol, and FA were reacted in the following manner in a resin flask equipped with mechanized stirring, nitrogen feed, a Dean-Stark trap, and a heating mantle. Solvent (Aromatic-100) and the PIB-cresol were introduced to the flask and the mixture was heated to 40° C., with a slight exotherm being noted. Approximately 75% of the total calculated Aromatic 100 was added at this step. The mixed materials were stirred and heated at 40° C. under a nitrogen gas ($N_2$) blanket (the nitrogen gas pressure in the flask was set at approximately 0.1 SCFH) until the mixture became homogenous. The DAC was added and the temperature of the combination was 40- 45° C. Next, 37% formaldehyde solution was added gradually while vigorous stirring was maintained. A mild exotherm was noted. The temperature was increased to 80° C. and held for 30 to 60 minutes. The temperature was increased to 145° C. for distillation using a Dean Stark trap. Distillation commenced in about 30 minutes, at a temperature of approximately 95-100° C. Once distillation began, the nitrogen gas flow was adjusted to 0.5 SCFH. The temperature was maintained at 145° C. for about an additional 2 to 2.5 hours. From the total weight of the product in the reaction flask after distillation, the amount of additional solvent needed to bring the final package composition to 25% solvent was calculated and added. The mole ratios of DAC: PIB-cresol:FA used in the Mannich reaction were 1.0:1.0:1.0, respectively.

Results from the PFI rig test are reported in Table 3 below.

TABLE 3

| Test Run | Fuel Composition | PFI Deposits (plugging rate, %) |
|---|---|---|
| 1 | DACH Mannich | 4.3 |
| 2 | Base Fuel | 4.9 |
| 3 | Base Fuel | 1.1 |
| 4 | Base Fuel | 6.4 |

As can be seen from the results in Table 3, the port fuel injectors provide excellent deposit control when the fuel composition contains the DACH Mannich. Additionally, the treated port fuel injectors continue to provide deposit control after contacting with the DACH Mannich ceases, i.e., when the fuel composition no longer contains the DACH Mannich (Test Runs 2, 3, and 4). Advantageously, the treated port fuel injectors provide excellent deposit control, even when repeatedly challenged with fuels containing no deposit control additive.

Example 3

Comparative Example

Port fuel injectors were subjected to the PFI rig test, first using the base fuel alone, to establish a baseline plugging rate, then using a fuel including one or more conventional additives, and then once again using the base fuel alone. Additives, treat rates, and results are reported in Tables 4-6 below.

TABLE 4

| Test Run | Fuel Composition | Treat Rate (ptb) | PFI Deposits (plugging rate, %) |
|---|---|---|---|
| 0 | Base Fuel | | 24.1 |
| 1 | 1600 MW Polyetheramine* & Diethylamide of Isostearic Acid | 80<br>20 | 5.1 |
| 2 | Base Fuel | | 27.5 |

*"Actaclear 2400" available from Bayer Material Science

TABLE 5

| Test Run | Fuel Composition | Treat Rate (ptb) | PFI Deposits (plugging rate, %) |
|---|---|---|---|
| 0 | Base Fuel | | 24.1 |
| 1 | OGA 402* | 80 | 7.8 |
| 2 | Base Fuel | | 24.4 |

*detergent available from Chevron

TABLE 6

| Test Run | Fuel Composition | Treat Rate (ptb) | PFI Deposits (plugging rate, %) |
|---|---|---|---|
| 0 | Base Fuel | | 30.9 |
| 1 | Mannich of PIB phenol w/DMAPA* | 80 | 10.1 |
| 2 | Base Fuel | | 17.8 |

*"HiTEC ® 4980 Detergent" available from Afton Chemical Corporation

As can be seen from the results in Tables 4-6, while conventional additives may provide some deposit control for the injectors when the fuel composition includes the deposit control additive, they do not provide effective deposit control once the additive is removed from the fuel composition. For example, in each case during Test Run 3, when the fuel contained no additive, the injectors fouled, with plugging rates approaching or exceeding baseline plugging levels.

Accordingly, the results in Tables 1-6 emphasize that the treated port fuel injectors, in contrast with the conventional port fuel injectors, effectively control deposit formation even when a fuel does not contain a deposit control additive. Thus, the film formed on the surface of the treated port fuel injectors remains on the surface after contacting with the additive ceases, and continues to provide effective resistance against the formation of deposits, even when a fuel is subsequently passed through the injector.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as a Mannich condensation reaction) or in forming a desired composition (such as an additive concentrate or additized fuel blend). It will also be recognized that the additive components can be added or blended into or with the base fuels individually per se and/or as components used in forming preformed additive combinations and/or sub-combinations. Likewise, preformed additive concentrates, in which higher proportions of the additive components are blended together usually with one or more diluents or solvents, can be formed so that subsequently the concentrate can be blended with a base fuel in the course of forming the finished fuel composition. Accordingly, even though the claims hereinafter may refer to substances, components and/or ingredients in the present tense ("comprises", "is", etc.), the reference is to the substance, component or ingredient as it exists or may have existed at the time just before it was first blended or mixed with one or more other substances, components and/or ingredients in accordance with the present disclosure. The fact that the substance, component or ingredient may have lost its original identity through a chemical reaction or transformation during the course of such blending or mixing operations is thus wholly immaterial for an accurate understanding and appreciation of this disclosure and the claims thereof.

Each and every patent or other publication referred to in any portion of this specification is incorporated in its entirety into this disclosure by reference for all purposes, as if fully set forth herein.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A treated port fuel injector comprising a port fuel injector having a surface coated by a film, wherein the film is formed by contacting the port fuel injector with:

(i) a succinimide compound comprising the reaction product of polyisobutylene-substituted succinic anhydride and a polyamine;

(ii) a Mannich base detergent; and (iii) a spark ignition fuel, wherein the film remains on the port fuel injector surface and resists deposit formation after the contacting ceases.

2. The treated port fuel injector according to claim 1, wherein the film remains on the port fuel injector surface and resists the formation of deposits when a fuel is subsequently passed through the injector.

3. The treated port fuel injector according to claim 2, wherein the film remains on the port fuel injector surface and resists the formation of deposits when a fuel which does not contain the succinimide compound and the Mannich base detergent is subsequently passed through the injector.

4. The treated port fuel injector according to claim 1, wherein the polyisobutylene-substituted succinic anhydride and the polyamine are reacted in a molar ratio of from about 2:1 to about 1:1.

5. The treated port fuel injector according to claim 1, wherein the polyamine is selected from diethylene triamine, triethylene tetramine, tetraethylene pentamine, pentaethylene hexamine, heavy polyamines, and mixtures thereof.

6. The treated port fuel injector according to claim 5, wherein the polyamine comprises tetraethylene pentamine.

7. The treated port fuel injector according to claim 1, wherein the Mannich base detergent comprises the reaction product of an alkyl-substituted hydroxyaromatic compound, an amine, and an aldehyde.

8. The treated port fuel injector according to claim 7, wherein the Mannich base detergent comprises the reaction product of alkylated cresol, a secondary amine, and at least one aldehyde.

9. A method for forming a film on a port fuel injector surface for resisting deposit formation comprising:

introducing into the port fuel injector: (i) a succinimide compound comprising the reaction product of polyisobutylene-substituted succinic anhydride and a polyamine; (ii) a Mannich base detergent; and (iii) a spark ignition fuel;

contacting the surface of the port fuel injector with: (i) the succinimide compound; (i) the Mannich base detergent; and (iii) the spark ignition fuel; and depositing a film on the surface, wherein the film remains on the port fuel injector surface and resists deposit formation after the contacting ceases.

10. The method according to claim 9, wherein the polyisobutylene-substituted succinic anhydride and the polyamine are reacted in a molar ratio of from about 2:1 to about 1:1.

11. The method according to claim 9, wherein the polyamine is selected from diethylene triamine, triethylene tetramine, tetraethylene pentamine, pentaethylene hexamine, heavy polyamines, and mixtures thereof.

12. The method according to claim 11, wherein the polyamine comprises tetraethylene pentamine.

13. The method according to claim 9, wherein the Mannich base detergent comprises the reaction product of an alkyl-substituted hydroxyaromatic compound, an amine, and an aldehyde.

14. The method according to claim 13, wherein the Mannich base detergent comprises the reaction product of alkylated cresol, a secondary amine, and at least one aldehyde

15. A method of minimizing or reducing port fuel injector deposits in an internal combustion engine comprising:

forming a film on the surfaces of the port fuel injectors in accordance with the method of claim 9;

providing a fuel, which may or may not contain port fuel injector deposit control additives, to the engine for the operation of said engine; and operating said engine.

16. A treated port fuel injector comprising a port fuel injector having a surface coated by a film, wherein the film is formed by contacting the port fuel injector with: (i) a Mannich condensation reaction product of a polyamine having a sterically-hindered primary amino group, a hydrocarbyl-substituted hydroxyaromatic compound, and an aldehyde; and (ii) a spark ignition fuel, wherein the film remains on the port fuel injector surface and resists deposit formation after the contacting ceases.

17. The treated port fuel injector according to claim 16, wherein the film remains on the port fuel injector surface and resists the formation of deposits when a fuel is subsequently passed through the injector.

18. The treated port fuel injector according to claim 17, wherein the film remains on the port fuel injector surface and resists the formation of deposits when a fuel, which does not contain the Mannich condensation reaction product, is subsequently passed through the injector.

19. The treated port fuel injector according to claim 16, wherein the polyamine comprises a polyaminocycloalkane having at least one sterically-hindered primary amino group.

20. The treated port fuel injector according to claim 16, wherein the polyamine comprises diaminocyclohexane.

21. The treated port fuel injector according to claim 20, wherein the polyamine comprises 1,2-diaminocyclohexane.

22. The treated port fuel injector according to claim 16, wherein the mole ratio of polyamine, hydroxyaromatic compound, and aldehyde is 0.6-1.4:0.6-1.4:0.6-1.4, respectively.

23. The treated port fuel injector according to claim 16, wherein the hydrocarbyl-substituted hydroxyaromatic compound comprises ortho-cresol, phenol, or a mixture of ortho-cresol and phenol, having an aliphatic hydrocarbyl substituent derived from a polyolefin having an average molecular weight in the range of from about 300 to about 2000.

24. The treated port fuel injector according to claim 23, wherein the aliphatic hydrocarbyl sustituent comprises polyisobutylene.

25. A method for forming a film on a port fuel injector surface for resisting deposit formation comprising:

introducing into the port fuel injector: (i) a Mannich condensation reaction product of a polyamine having a sterically-hindered primary amino group, a hydrocarbyl-substituted hydroxyaromatic compound, and an aldehyde; and (ii) a spark ignition fuel;

contacting the surface of the port fuel injector with the Mannich reaction product and the spark ignition fuel; and depositing a film on the surface, wherein the film remains on the port fuel injector surface and resists deposit formation after the contacting ceases.

26. The method according to claim 25, wherein the polyamine comprises a polyaminocycloalkane having at least one sterically-hindered primary amino group.

27. The method according to claim 26, wherein the polyamine comprises diaminocyclohexane.

28. The method according to claim 27, wherein the polyamine comprises 1,2-diaminocyclohexane.

29. The method according to claim 25, wherein the mole ratio of polyamine, hydroxyaromatic compound, and aldehyde is 0.6-1.4:0.6-1.4:0.6-1.4, respectively.

30. The method according to claim 25, wherein the hydrocarbyl-substituted hydroxyaromatic compound comprises ortho-cresol, phenol, or a mixture of ortho-cresol and phenol, having an aliphatic hydrocarbyl substituent derived from a polyolefin having an average molecular weight in the range of from about 300 to about 2000.

31. The method according to claim 30, wherein the aliphatic hydrocarbyl sustituent comprises polyisobutylene.

32. A method of minimizing or reducing port fuel injector deposits in an internal combustion engine comprising:

forming a film on the surfaces of the port fuel injectors in accordance with the method of claim 25;

providing a fuel to the engine, which may or may not contain port fuel injector deposit control additives, for the operation of said engine; and operating said engine.

* * * * *